US010859333B2

(12) United States Patent
Overbeck et al.

(10) Patent No.: US 10,859,333 B2
(45) Date of Patent: Dec. 8, 2020

(54) MAGAZINE RETAINING DEVICE

(71) Applicant: IMPACT HARDWARE, LLC, Reno, NV (US)

(72) Inventors: Jeffery Overbeck, Clearwater, FL (US); Kyle Sherman, Folsom, CA (US)

(73) Assignee: IMPACT HARDWARE, LLC, Reno, NV (US)

( * ) Notice: Subject to any disclaimer, the term of this patent is extended or adjusted under 35 U.S.C. 154(b) by 0 days.

(21) Appl. No.: 15/391,725

(22) Filed: Dec. 27, 2016

(65) Prior Publication Data

US 2017/0184369 A1 Jun. 29, 2017

Related U.S. Application Data

(60) Provisional application No. 62/271,763, filed on Dec. 28, 2015.

(51) Int. Cl.
*F41A 9/65* (2006.01)
*F42B 39/02* (2006.01)

(52) U.S. Cl.
CPC ..... *F41A 9/65* (2013.01); *F42B 39/02* (2013.01)

(58) Field of Classification Search
CPC ..... F41A 35/00; F41A 9/65
USPC ..... 42/90; 89/34
See application file for complete search history.

(56) References Cited

U.S. PATENT DOCUMENTS 4,115,943 A * 9/1978 Musgrave ..... F41A 9/63 42/71.01
4,484,404 A * 11/1984 Johnson ..... F41A 17/38 42/90
5,253,442 A * 10/1993 Kim ..... F41A 17/38 42/50
6,668,479 B1 * 12/2003 Obong ..... F41A 9/63 206/3
6,698,127 B2 * 3/2004 Weber ..... F41A 9/65 42/49.01
6,698,129 B1 * 3/2004 Hanks ..... F41A 9/63 42/90
7,497,043 B2 * 3/2009 Clifton, Jr. ..... F41A 9/63 224/239
7,975,420 B2 * 7/2011 Pestana ..... F41A 9/68 224/931
8,640,374 B1 * 2/2014 Reichelt ..... F41C 27/00 42/106
8,739,451 B2 * 6/2014 Nelson ..... F41A 9/65 220/23.4
9,581,400 B2 * 2/2017 Dove ..... F41A 9/01
2010/0263255 A1 * 10/2010 Harris ..... F41C 27/00 42/90
2015/0308790 A1 * 10/2015 Gravelle ..... F42B 39/00 42/90

* cited by examiner

*Primary Examiner* — Stephen Johnson
*Assistant Examiner* — Benjamin S Gomberg
(74) *Attorney, Agent, or Firm* — Karr Tuttle Campbell; Kyle Straughan

(57) ABSTRACT

The present disclosure relates to magazine retaining devices and methods to produce such magazine retaining devices that may be coupled to a rail, such as a Picatinny rail, and used to retain a firearm magazine.

14 Claims, 6 Drawing Sheets

MAGAZINE RETAINING DEVICE

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)). In addition, the present application is related to the "Related Applications," if any, listed below.

PRIORITY APPLICATIONS

U.S. Provisional Patent Application Ser. No. 62/271,763, entitled Magazine Retaining Device, naming as inventors Jeffrey Overbeck and Kyle Sherman, filed 28 Dec. 2015.

RELATED APPLICATIONS

U.S. Provisional Patent Application Ser. No. 62/271,763, entitled Magazine Retaining Device, naming as inventors Jeffrey Overbeck and Kyle Sherman, filed 28 Dec. 2015.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

SUMMARY

In some embodiments, a magazine retaining device includes, but is not limited to, an elongated tubular body including an upper wall, a lower wall, and two side walls each coupled to the upper wall and the lower wall to form an aperture that is configured to receive a firearm magazine within an interior portion of the aperture, wherein the tubular body includes at least one open end; and a rail engagement structure coupled to an exterior surface of the tubular body and configured to slideably engage a rail.

In some embodiments, a magazine retaining device includes, but is not limited to, an elongated tubular body including an upper wall, a lower wall, and two side walls each coupled to the upper wall and the lower wall to form an aperture that is configured to receive a firearm magazine within an interior portion of the aperture, wherein the tubular body includes an open end and a partially closed end; a magazine retaining structure coupled to an interior surface of the aperture; a rail engagement structure including two rail feet coupled to an exterior surface of the tubular body and configured to partially encircle and be slideably coupled to a picatinny rail; one or more support ridges operably coupled to an external surface of the tubular body and positioned between the two rail feet that are operably coupled to an external surface of the tubular body; and a rail locking structure that includes a retractable locking portion that is configured to insert into at least one recess in a rail to which the magazine retaining device can be mounted.

In some embodiments, a method for forming a magazine retaining device includes, but is not limited to, forming an elongated tubular body including an upper wall, a lower wall, and two side walls each coupled to the upper wall and the lower wall to form an aperture that is configured to receive a firearm magazine within an interior portion of the aperture, wherein the tubular body includes at least one open end; and forming a rail engagement structure coupled to an exterior surface of the tubular body and configured to slideably engage a rail.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

DETAILED DESCRIPTION

Figure 1:
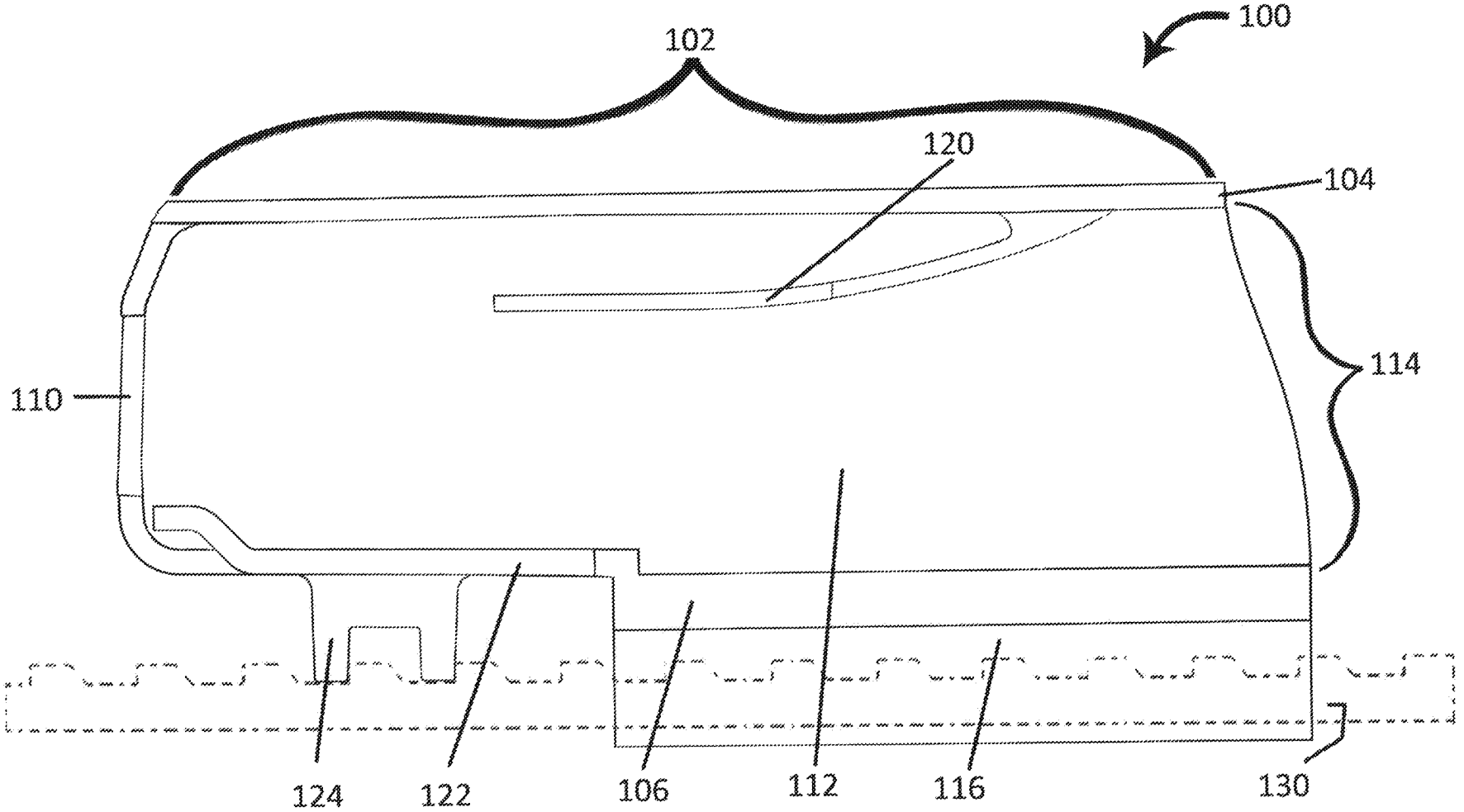
FIG. 1 illustrates a cross-sectional side view of an example device in which embodiments may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Magazine Retaining Device

In some embodiments, a magazine retaining device 100 includes, but is not limited to a device configured to be coupled to a rail 128. In some embodiments, a magazine retaining device 100 includes, but is not limited to a device configured to be coupled to a Picatinny rail 130. In some embodiments, a magazine retaining device 100 may be coupled to a rail 128 that is attached to a firearm. In some embodiments, a magazine retaining device 100 may be coupled to a rail 128 that is attached to an object such as a belt, a vest, a helmet, and the like. In some embodiments, a magazine retaining device 100 may be used to secure a magazine 132 used in a firearm. In some embodiments, a magazine retaining device 100 may be used to secure a magazine 132 used in a firearm to a rail 128, such as a Picatinny rail 130, that is coupled to the firearm. In some embodiments, a magazine retaining device 100 may be coupled to a rail 128 that is attached to an object such as a belt, a vest, a helmet, and the like.

In some embodiments, a magazine retaining device 100 may include an elongated tubular body 102 that includes an aperture 112 that is configured to receive one or more firearm magazines 132 into an interior portion of the aperture 112. Accordingly, in some embodiments, the tubular body 102 of a magazine retaining device 100 includes at least one open end 114.

In some embodiments, a magazine retaining device 100 includes a rail engagement structure 116 coupled to an exterior surface of the tubular body 102 of the magazine retaining device 100. This rail engagement structure 116 may be used to removeably and/or permanently attach the magazine retaining device 100 to a rail 128. In some embodiments, such a rail 128 may be coupled to a firearm. Accordingly, in some embodiments, the rail engagement structure 116 may be used to attach a magazine retaining device 100 to a firearm.

In some embodiments, a magazine retaining device 100 includes a magazine retaining structure 120. In some embodiments, a magazine retaining structure 120 may be coupled to an interior portion of the aperture 112 of the magazine retaining device 100. In some embodiments, the magazine retaining structure 120 may be configured to retain a magazine 132 within the aperture 112 of a magazine retaining device 100.

In some embodiments, a magazine retaining device 100 includes one or more support ridges 126. In some embodiments, the one or more support ridges 126 are coupled to the exterior of the tubular body 102 of the magazine retaining device 100. In some embodiments, the one or more support ridges 126 are positioned on the tubular body 102 of the magazine retaining device 100 that is immediately adjacent a rail 128 to which the magazine retaining device 100 is coupled.

In some embodiments, a magazine retaining device 100 includes a rail locking structure 122. In some embodiments, a rail locking structure 122 may be coupled to a magazine retaining device 100 such that the rail locking structure 122 is positioned to engage with a rail 128 in order to lock the associated magazine retaining device 100 in place on the rail 128.

Tubular Body

In some embodiments, a magazine retaining device 100 includes a tubular body 102. Accordingly, in some embodiments, a tubular body 102 may include an upper wall 104, a lower wall 106, and two side walls 108 wherein the two side walls 108 are each coupled to the upper wall 104 and the lower wall 106 to form a tubular body 102 that includes an aperture 112 through the longitudinal center of the tubular body 102. In some embodiments, a tubular body 102 may include an end wall 110 on one end of the tubular body 102. In some embodiments, the end wall 110 may include a hole disposed therein to form a partially closed end on the tubular body 102. In some embodiments, the end wall 110 may be solid to form a closed end on the tubular body 102. The tubular body 102 may be configured in numerous ways to provide apertures 112 with numerous cross-sectional geometries. For example, in some embodiments, the upper wall 104, lower wall 106, and side walls 108 may be substantially flat such that the aperture 112 of the tubular body 102 has a substantially rectangular (including substantially square) structure. In some embodiments, the upper wall 104, lower wall 106, and side walls 108 may be curved such that the aperture 112 of the tubular body 102 has an oblong or rounded structure. In some embodiments, the upper wall 104 and lower wall 106 may be substantially flat and the side walls 108 may be curved such that the aperture 112 of the tubular body 102 has a substantially flattened oval structure. Accordingly, in some embodiments, the structure of the tubular body 102 of a magazine retaining device 100 may be configured to create an aperture 112 that is able to receive magazines 132 of numerous shapes and sizes. Accordingly, the end wall 110 may be configured to conform to the geometry of the tubular body 102.

In some embodiments, a tubular body 102 may include an aperture 112 having one open end 114 and one closed end. In some embodiments, tubular body 102 may include an aperture 112 having two open ends 114. In some embodiments, a tubular body 102 may include an aperture 112 having one open end 114 and one partially closed end.

In some embodiments, a tubular body 102 may include an aperture 112 that is configured to receive a magazine designed for a pistol. Examples of such pistol magazines 132 include those designed for use with Glock® pistols, 1911-type pistols, and the like. In some embodiments, a tubular body 102 may include an aperture 112 that is configured to receive a magazine 132 designed for a rifle. Examples of such rifle magazines 132 include those designed for use with Kel-Tec® rifles, AR-15-type rifles, and the like.

In some embodiments, a tubular body 102 may be constructed from a clear material to provide for inspection of a magazine 132 held within the tubular body 102. In some embodiments, a tubular body 102 may be constructed to include a clear window incorporated into one or more sides of the tubular body 102 to provide for inspection of a magazine 132 held within the tubular body 102.

Rail Engagement Structure

In some embodiments, a magazine retaining device 100 includes a rail engagement structure 116. Rail engagement structures 116 may be configured in numerous ways. For example, in some embodiments, a rail engagement structure 116 may be configured with two rail feet 118 that engage two longitudinal sides of a rail 128. Examples of such rails 128 include, but are not limited to, Picatinny rails 130, Weaver rails 148, and the like. In some embodiments, a rail engagement structure 116 may configured to be slideable on a rail 128. Accordingly, in some embodiments, the position of a magazine retaining device 100 on a rail 128 may be selected by a user.

Magazine Retaining Structure

In some embodiments, a magazine retaining device 100 includes a magazine retaining structure 120. In some embodiments, a magazine retaining structure 120 serves to secure a magazine 132 within an aperture 112 included within a magazine retaining device 100. In some embodiments, a magazine retaining structure 120 may be coupled to an upper portion of the interior of an aperture 112 within a magazine retaining device 100. In some embodiments, a magazine retaining structure 120 may be coupled to a lower portion of the interior of an aperture 112 within a magazine retaining device 100. In some embodiments, a magazine retaining structure 120 may be coupled to a side portion of the interior of an aperture 112 within a magazine retaining device 100. In some embodiments, a magazine retaining structure 120 may be configured as a compressible arm that is coupled to the interior of an aperture 112 within a magazine retaining device 100. The compressible arm exerts pressure on a magazine 132 present within the aperture 112 and thereby holds the magazine 132 in place within the aperture 112. Accordingly, in some embodiments, a magazine 132 may be inserted into an aperture 112 within a magazine retaining device 100, secured in place by one or more magazine retaining structures 120 included within the aperture 112, and then withdrawn for use. In some embodiments, a magazine retaining structure 120 may be configured in other ways. For example, in some embodiments, a magazine retaining structure 120 may include a compression spring that secures a magazine 132 within an aperture 112 of a magazine retaining device 100. Accordingly, a magazine retaining structure 120 may be configured in various ways.

Rail Locking Structure

In some embodiments, a magazine retaining device 100 includes a rail locking structure 122. In some embodiments, a rail locking structure 122 may be used to fix the position of a magazine retaining device 100 onto a rail 128, such as a Picatinny rail 130. In some embodiments, a rail locking structure 122 may include a locking portion 124 that protrudes from the surface of a magazine retaining device 100 that is immediately adjacent to a rail 128 such that the locking portion 124 engages the rail 128 and fixes the associated magazine retaining device 100 in place. In some embodiments, the locking portion 124 may insert into at least one recess in the rail 128 to which the magazine retaining device 100 is mounted.

Support Ridges

In some embodiments, a magazine retaining device 100 includes one or more support ridges 126. In some embodiments, a magazine retaining device 100 may include multiple support ridges 126 (e.g., two, three, four, and the like). In some embodiments, one or more support ridges 126 may be configured to stabilize a magazine retaining device 100 on a rail 128, such as a Picatinny rail 130. For example, in some embodiments, one or more support ridges 126 may be positioned on the exterior surface of the tubular body 102 of a magazine retaining device 100 that is in contact with the surface of a rail 128. In some embodiments, the one or more support ridges 126 may be positioned between two rail feet 118 on the surface of the magazine retaining device 100. Accordingly, the support ridges 126 may be configured to provide a selectable friction fit between a rail 128 and a magazine retaining device 100 (e.g., adjusting the height of the support ridges 126). In some embodiments, the support ridges 126 may be designed to stabilize a magazine retaining device 100 that is supporting a magazine 132 having a certain weight or range of weights. For example, in some embodiments, one or more support ridges 126 may be configured to stabilize a light weight magazine 132 when attached to a rail 128. In some embodiments, one or more support ridges 126 may be configured to stabilize a heavy weight magazine 132 when attached to a rail 128. In some embodiments, one or more support ridges 126 may be used to provide a selected space between a magazine retaining device 100 and an attached rail 128 to control the position of a magazine 132 contained within the magazine retaining device 100. For example, the height of the support ridges 126 may be increased to cause the end of a magazine 132 contained within a magazine retaining device 100 to protrude away from a rail 128 to which the magazine retaining device 100 is attached. Alternatively, the height of the support ridges 126 may be decreased to cause the end of a magazine 132 contained within a magazine retaining device 100 to be held closer to a rail 128 to which the magazine retaining device 100 is attached.

Materials and Fabrication

Magazine retaining device 100 and the components of magazine retaining device 100 may be constructed of numerous types of material and combinations of materials. In some embodiments, magazine retaining device 100 and/or components of magazine retaining device 100 may be constructed from a single type of material (e.g., a polymer). For example, a single type of polymer may be used when magazine retaining device 100 and variations thereof are produced as a single article through use of blow molding. In some embodiments, magazine retaining device 100 and/or components of magazine retaining device 100 may be constructed from numerous types of metals and combinations of metals (e.g., steel, aluminum, titanium, metal alloys, and the like), polymers, plastics (e.g., polyethylene terephthalate, polyethylene, high-density polyethylene, polyvinyl chloride, polyvinylidene chloride, low-density polyethylene, polypropylene, polystyrene, high impact polystyrene, polyamides, acrylonitrile butadiene styrene, polycarbonate, polycarbonate/acrylonitrile butadiene styrene, and the like), and the like.

Magazine retaining device 100 and the components of magazine retaining device 100 may be manufactured through use of numerous fabrication methods. Examples of such fabrication methods include, but are not limited to, machining, casting, molding, printing (e.g., three-dimensional printing), and the like. In some embodiments, magazine retaining device 100 and variations thereof may be fabricated as a single article through use of blow molding. In some embodiments, magazine retaining device 100 and variations thereof may be fabricated as separate pieces and then assembled.

FIG. 1 illustrates a cross-sectional side view of an example magazine retaining device 100 in which embodiments may be implemented. The tubular body 102 of the magazine retaining device 100 is illustrated as having an upper wall 104, a lower wall 106, an end wall 110, an aperture 112, and an open end 114. Magazine retaining structure 120 is illustrated as being coupled to the upper wall 104 within an interior portion of the aperture 112. A rail locking structure 122 is illustrated as having the locking portion 124 engaged with Picatinny rail 130 thereby fixing magazine retaining device 100 in place on the Picatinny rail 130. A rail engagement structure 116 is illustrated as being coupled to the Picatinny rail 130.

Figure 2:
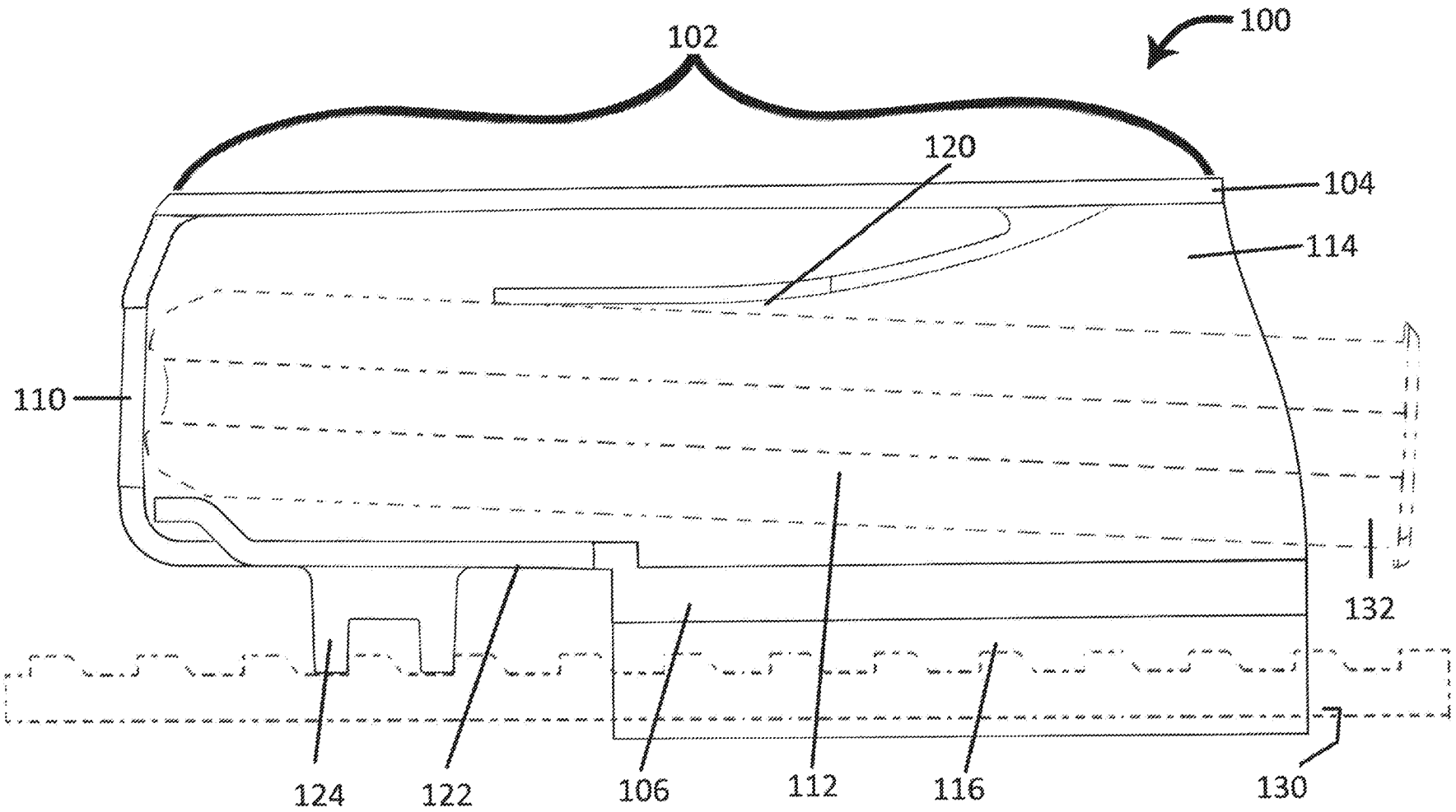
FIG. 2 illustrates a cross-sectional side view of an example device in which embodiments may be implemented.

FIG. 2 illustrates a cross-sectional side view of an example magazine retaining device 100 in which embodiments may be implemented. FIG. 2 corresponds to FIG. 1 with the addition of a magazine 132.

Figure 3:
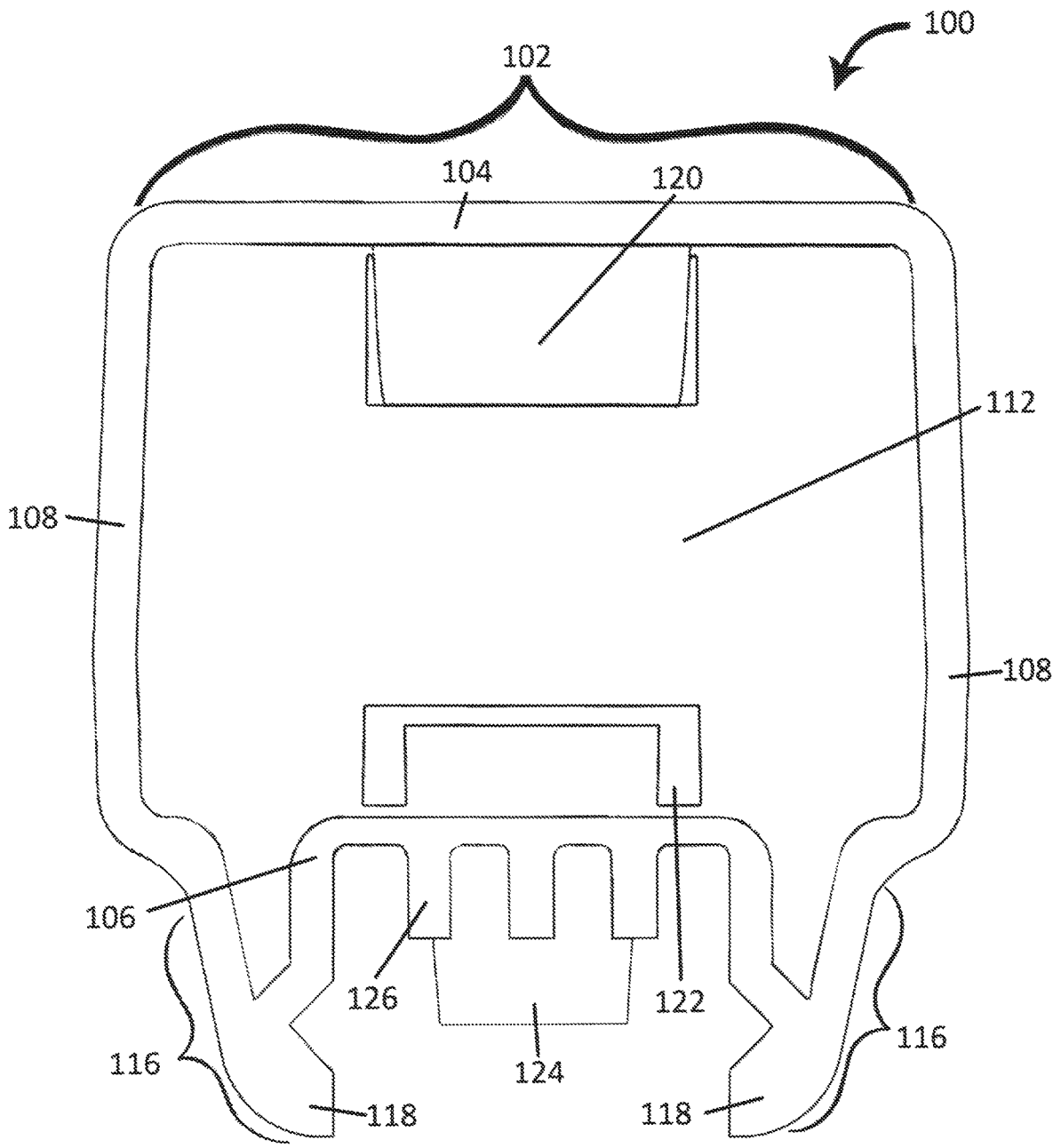
FIG. 3 illustrates a cross-sectional transverse view of an example device in which embodiments may be implemented.

FIG. 3 illustrates a cross-sectional transverse view of an example magazine retaining device 100 in which embodiments may be implemented. The upper wall 104, lower wall 106, and side walls 108 of tubular body 102 are illustrated. Magazine retaining structure 120 is illustrated as being coupled to the upper wall 104 within an interior portion of the aperture 112. Two rail feet 118 of rail engagement structure 116 are illustrated as protruding down from lower wall 106. The locking portion 124 of rail locking structure 122 is illustrated as protruding down between the two rail feet 118. Three support ridges 126 are also illustrated as protruding into the rail engagement structure 116.

Figure 4:
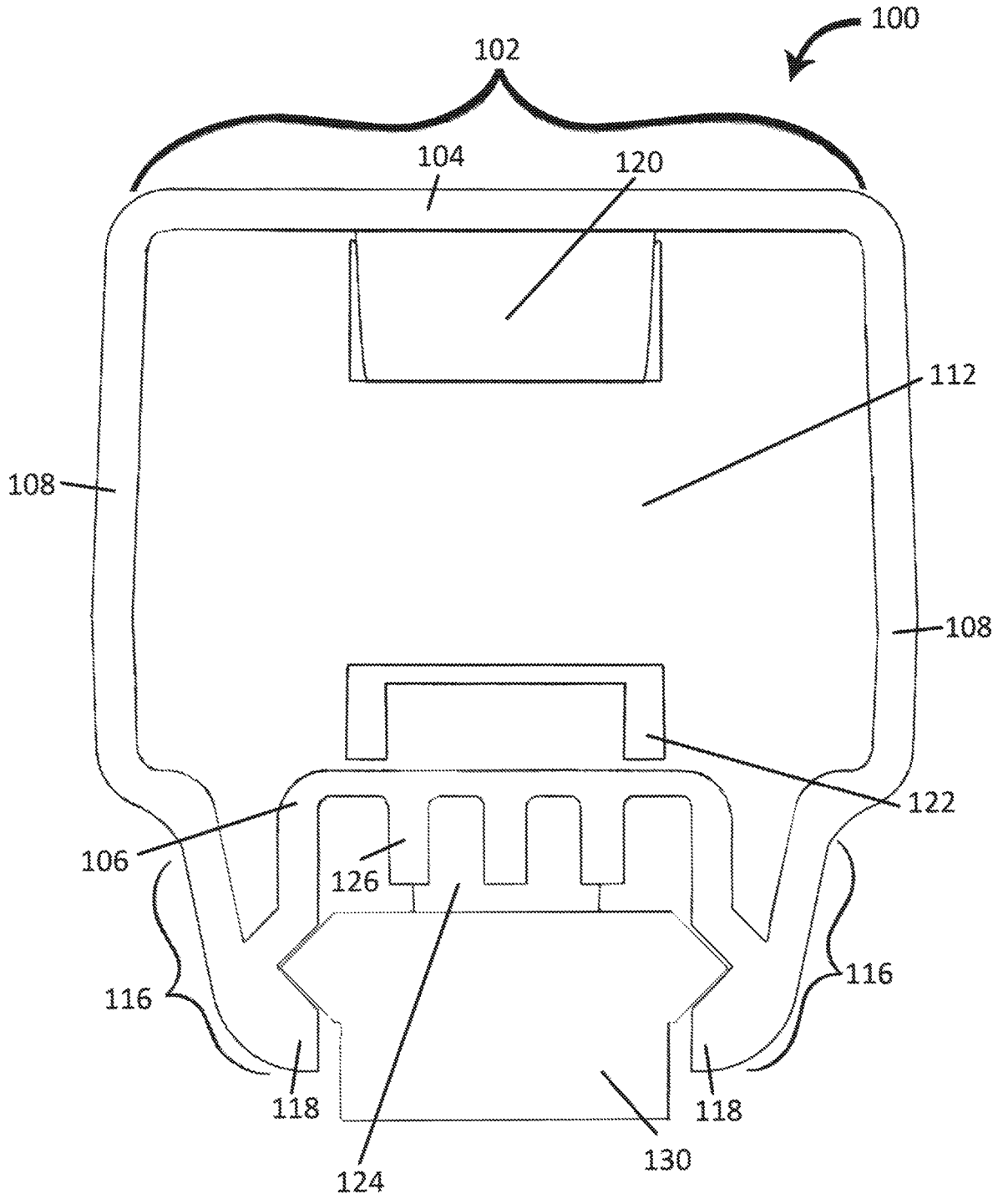
FIG. 4 illustrates a cross-sectional transverse view of an example device in which embodiments may be implemented.

FIG. 4 illustrates a cross-sectional transverse view of an example magazine retaining device 100 in which embodiments may be implemented. FIG. 4 corresponds to FIG. 3 with the addition of a Picatinny rail 130 that is coupled to two rail feet 118 of rail engagement structure 116. The locking portion 124 of rail locking structure 122 is also illustrated as engaging Picatinny rail 130.

Figure 5:
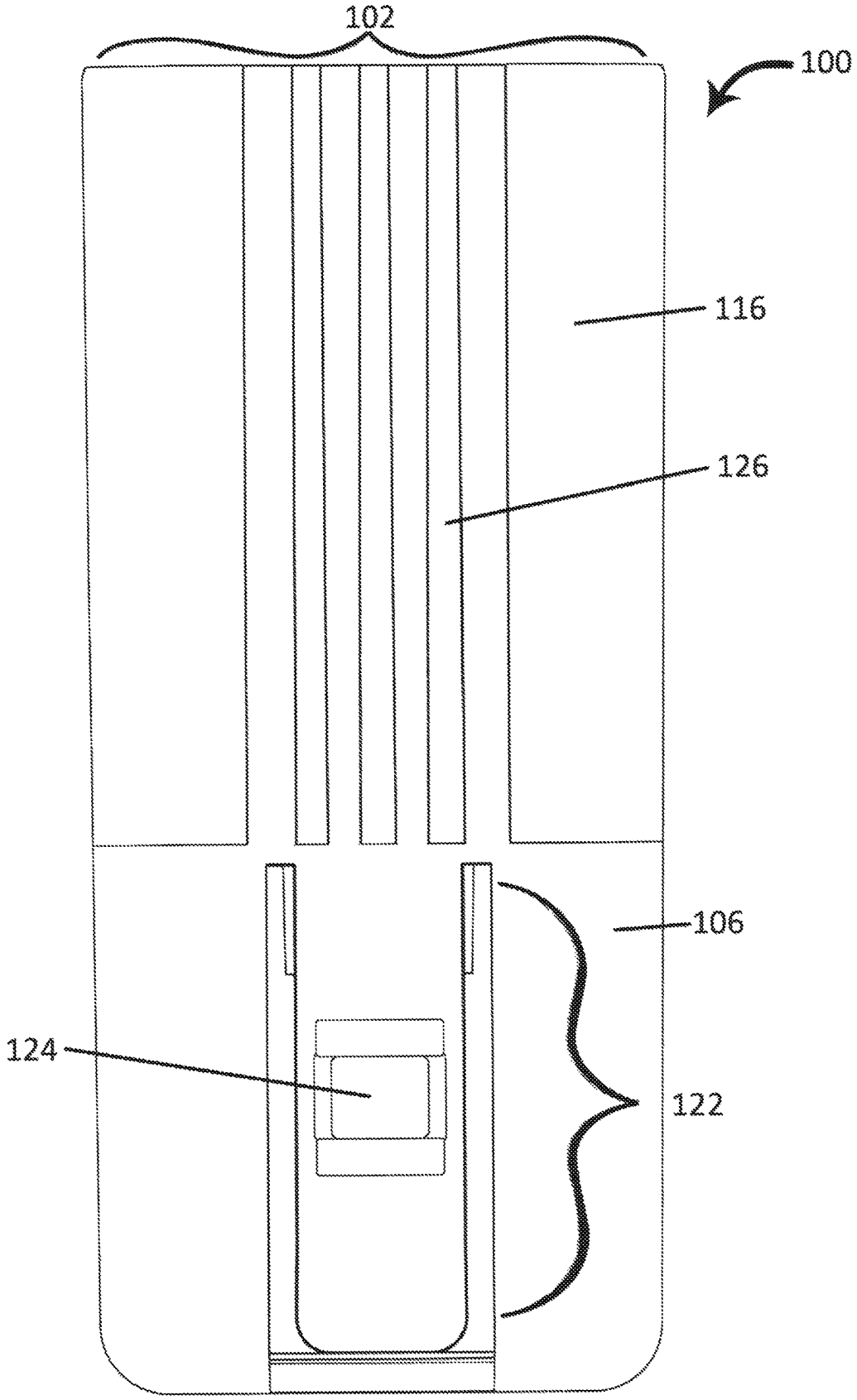
FIG. 5 illustrates a bottom view of a portion of an example device in which embodiments may be implemented.

FIG. 5 illustrates a bottom view of a portion of an example magazine retaining device 100 in which embodiments may be implemented. The lower wall 106 of the tubular body 102 is illustrated as being coupled to three support ridges 126 and to a rail engagement structure 116. The rail locking portion 124 of rail locking structure 122 is also illustrated. Rail locking structure 122 is illustrated as having two side cuts that allow the locking portion 124 to be raised and lowered relative to a rail 128 to which magazine retaining device 100 is attached to allow for engagement and disengagement of the locking portion 124 with the rail 128.

Figure 6:
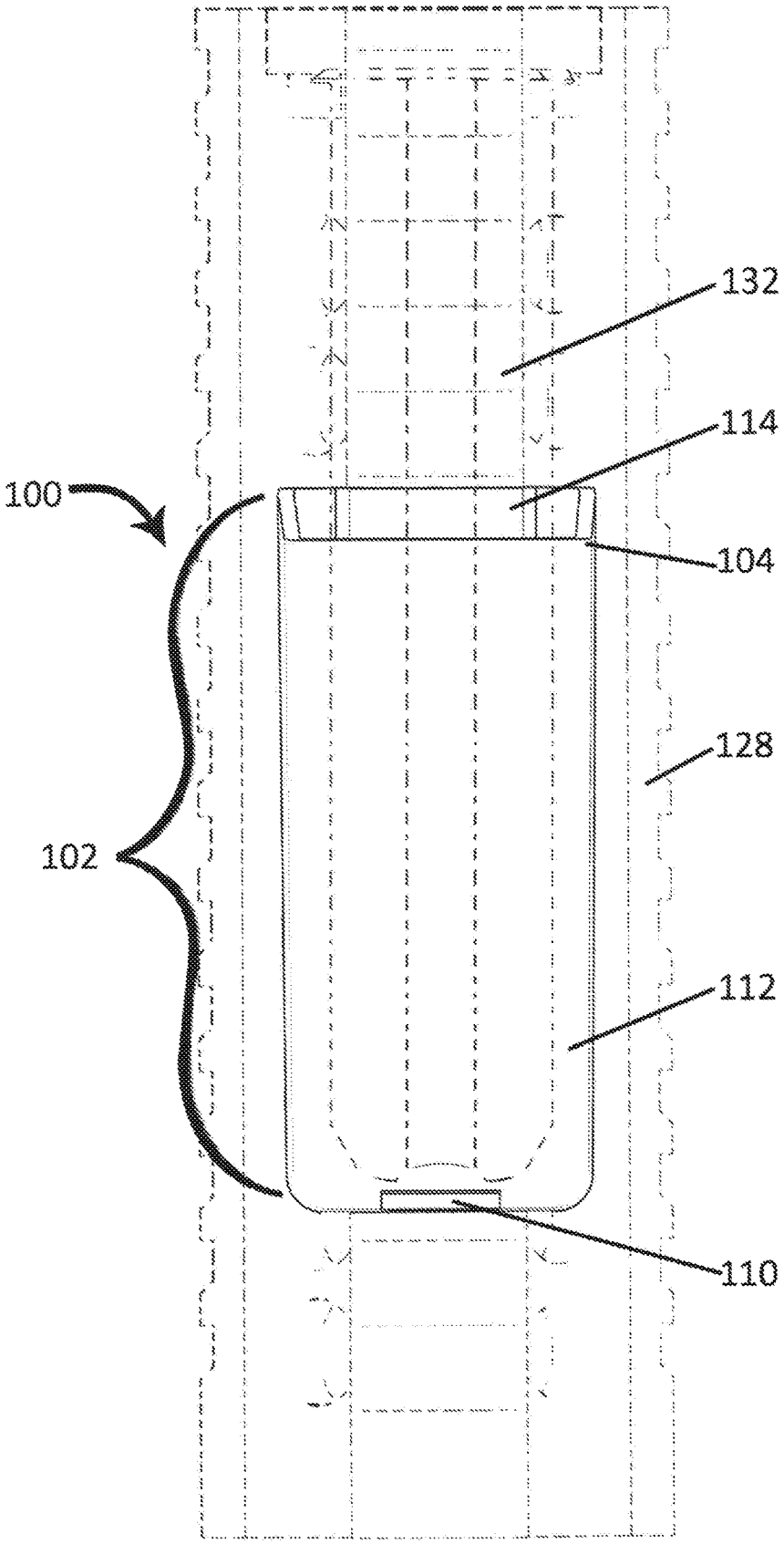
FIG. 6 illustrates a cross-sectional top view of an embodiment of an example device in which embodiments may be implemented.

FIG. 6 illustrates a cross-sectional top view of an embodiment of an example magazine retaining device 100 in which embodiments may be implemented. A magazine 132 is illustrated as being contained within the aperture 112 of tubular body 102. The open end 114, upper wall 104, and partially open end wall 110 of tubular body 102 is also illustrated. Rail 128 is illustrated as being coupled to magazine retaining device 100.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The particulars shown herein are by way of example. In this regard, no attempt is made to show structural details of the invention in more detail than is necessary for the fundamental understanding of the invention. The description taken with the drawings and/or examples make apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Specific elements of any foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

All publications, patents and patent applications cited herein are incorporated herein by reference. The foregoing specification has been described in relation to certain embodiments thereof, and many details have been set forth for purposes of illustration, however, it will be apparent to those skilled in the art that the invention is susceptible to additional embodiments and that certain of the details described herein may be varied considerably without departing from the basic principles of the invention.

What is claimed is:

1. A magazine retaining device comprising:

an elongated tubular body including an upper wall, a lower wall, and two side walls each coupled to the upper wall and the lower wall to form an aperture that is configured to receive a firearm magazine within an interior portion of the aperture, wherein the tubular body includes at least one open end and at least one partially closed end;

one or more magazine retaining structures coupled to an interior surface of the aperture and extending partially into the interior portion of the aperture at least partially in a direction away from the at least one open end and is further configured to frictionally couple to the firearm magazine and apply pressure to the firearm magazine opposite an edge of the at least one open end;

a rail engagement structure coupled to an exterior surface of the tubular body and configured to slideably engage a rail and comprising two substantially parallel rail feet configured to accommodate the rail between them and one or more substantially parallel support ridges configured to brace the tubular body against the rail; and a guide flange coupled to the interior surface adjacent the at least one partially closed end of the elongated tubular body, wherein the guide flange is configured to apply pressure to the firearm magazine opposite the one or more retaining structures such that the magazine is only in contact with the edge of the at least one open end of the elongated tubular body, the closed end of the elongated tubular body, the one or more retaining structures and the guide flange.

2. The magazine retaining device of claim 1, wherein the tubular body has a substantially rectangular cross-section.

3. The magazine retaining device of claim 1, wherein the partially closed end is opposite the at least one open end.

4. The magazine retaining device of claim 1, wherein the rail that the rail engagement structure is configured to slideably engage is a Picatinny rail.

5. The magazine retaining device of claim 1, wherein the rail engagement structure includes the two rail feet that are configured to partially encircle the rail, wherein the rail is a Picatinny rail.

6. The magazine retaining device of claim 1, further comprising:

a rail locking structure that includes a locking portion that is configured to be inserted into at least one recess in the rail.

7. The magazine retaining device of claim 6, wherein the rail locking structure is positioned between the two rail feet that are operably coupled to the exterior surface of the tubular body and configured to partially encircle the rail.

8. The magazine retaining device of claim 1, wherein the one or more support ridges are operably coupled to the exterior surface of the tubular body and positioned between the two rail feet that are operably coupled to the exterior surface of the tubular body and configured to partially encircle the rail.

9. The magazine retaining device of claim 1, wherein a rail locking structure is positioned between the two rail feet that are operably coupled to the exterior surface of the tubular body and configured to partially encircle the rail.

10. The magazine retaining device of claim 1, further comprising:

a rail locking structure that includes a retractable locking portion that is configured to be inserted into at least one recess in the rail.

11. The magazine retaining device of claim 1, wherein the one or more magazine retaining structures are comprised of a rectangular structure configured to compress the firearm magazine against an opposite interior surface of the aperture.

12. The magazine retaining device of claim 1, wherein one or more of the upper wall, lower wall, and two side walls is comprised of a polymer substance.

13. A magazine retaining device comprising:

an elongated tubular body including an upper wall, a lower wall, and two side walls each coupled to the upper wall and the lower wall to form an aperture that is configured to receive a firearm magazine within an interior portion of the aperture, wherein the tubular body includes an open end and a partially closed end;

a magazine retaining structure coupled to an interior surface of the aperture and extending partially into the interior portion of the aperture at least partially in a direction away from the at least one open end and further configured to frictionally couple to the firearm magazine and apply pressure to the firearm magazine opposite an edge of the open end;

a rail engagement structure including two rail feet coupled to an exterior surface of the tubular body and configured to partially encircle and be slideably coupled to a Picatinny rail and one or more substantially parallel support ridges configured to brace the tubular body against the Picatinny rail wherein the one or more support ridges operably coupled to the exterior surface of the tubular body and positioned between the two rail feet that are operably coupled to the exterior surface of the tubular body;

a rail locking structure that includes a retractable locking portion that is configured to be inserted into at least one recess in the Picatinny rail; and a guide flange coupled to the interior surface adjacent the partially closed end of the elongated tubular body, wherein the guide flange is configured to apply pressure to the firearm magazine opposite the retaining structure such that the magazine is only in contact with the edge of the at least one open end of the elongated tubular body, the closed end of the elongated tubular body, the one or more retaining structures and the guide flange.

14. A magazine retaining device comprising:

an elongated tubular body including an upper wall, a lower wall, and two side walls each coupled to the upper wall and the lower wall to form a squared aperture with rounded corners that is configured to receive a firearm magazine within an interior portion of the aperture, wherein the tubular body comprises an open end and a closed end which covers at least one-third or substantially one-third of the interior portion of the aperture;

a rectangular magazine retaining structure coupled to an interior side surface of the aperture and bending in a direction away from the at least one open end substantially one-third of the way into the interior portion of the aperture to be substantially parallel with the interior side surface of the aperture to press the firearm magazine into an opposite interior side surface of the aperture and further configured to frictionally couple to the firearm magazine and apply pressure to the firearm magazine opposite an edge of the at least one open end;

a rail engagement structure affixed to an outer side of the tubular body including two rail feet coupled to an exterior surface of the tubular body and configured to partially encircle and be slideably coupled to a Picatinny rail;

one or more support ridges operably coupled to the exterior surface of the tubular body and positioned between the two rail feet that are operably coupled to the exterior surface of the tubular body;

a rail locking structure affixed to the same outer side of the tubular body as the rail engagement structure that includes a retractable locking portion that is configured to be inserted into at least one recess in the Picatinny rail; and a guide flange coupled to the interior side surface adjacent the closed end of the elongated tubular body, wherein the guide flange is configured to apply pressure to the firearm magazine opposite the retaining structure such that the magazine is only in contact with the edge of the at least one open end of the elongated tubular body, the closed end of the elongated tubular body, the one or more retaining structures and the guide flange.

* * * * *